United States Patent [19]

Shulsinger

[11] 4,108,219

[45] Aug. 22, 1978

[54] AEROSOL DISPENSER WITH INNER CONTAINER AND PISTON

[76] Inventor: Joseph Shulsinger, 26907 Indian Peak Rd., Rancho Palos Verdes, Calif. 90274

[21] Appl. No.: 800,298

[22] Filed: May 25, 1977

[51] Int. Cl.[2] ..... B65D 83/14

[52] U.S. Cl. ..... 141/3; 141/20; 222/389

[58] Field of Search ..... 220/93; 141/3, 20, 27; 222/386, 389

[56] References Cited

U.S. PATENT DOCUMENTS

| | | | |
|---|---|---|---|
| 3,207,385 | 9/1965 | Featherstone et al. | 222/389 |
| 3,282,474 | 11/1966 | Gorman | 222/389 |
| 3,300,103 | 1/1967 | Featherstone et al. | 222/389 |
| 3,312,378 | 4/1967 | Featherstone et al. | 222/389 |

*Primary Examiner*—Stanley H. Tollberg
*Assistant Examiner*—David A. Scherbel
*Attorney, Agent, or Firm*—Joseph Shulsinger

[57] ABSTRACT

A can for spraying atomized liquids comprising a pair of coaxial cylinders, the outer cylinder forming the sealed can body. The liquid to be atomized and sprayed is contained within the central cylinder above a piston. The central and outer cylinders are in fluid communication through openings in the central cylinder near the bottom of the can. The piston, which is double-ended, is movable located within the central cylinder. A gas or other fluid under pressure is located in the volume between the central and outer cylinders, thus exerting a force on the bottom of the piston to drive the fluid to be sprayed out of the central cylinder when the atomizing valve is manually actuated.

4 Claims, 2 Drawing Figures

AEROSOL DISPENSER WITH INNER CONTAINER AND PISTON

BACKGROUND OF THE INVENTION

In today's marketplace, one of the products which has been proven to be most useful has been the aerosol spray can. Such cans have been used for an exceptionally wide variety of products including paint, hair sprays, whipped cream, etc.

It has recently been discovered that the spray cans known in the prior art have, unfortunately, often employed propellant gasses, mixed with the material to be sprayed, which are released to the atmosphere when the aerosol valve is actuated by the user. The initial conclusions from on-going testing are that the propellant gasses which are released to the atmosphere may be environmentally harmful. The current supposition is that the gasses will break down the earth's ozone layer, causing an increase in the sun's ultraviolet rays which will strike the earth and, possibly, thereby cause an increase in skin cancer.

Consequently, many legislative and administrative government bodies are considering and/or undertaking various actions which will result in banning the spray cans containing such propellants from the marketplace.

Other propellants which do not significantly pollute the environment often have undesirable side effects, such as unpleasantly cooling the object being sprayed.

Further, most of the present day aerosol cans are somewhat position sensitive. In other words, the product cannot be sprayed from the can at all when the can is tilted so that its axis is oriented at an angle greater than a certain degree with respect to vertical. In an extreme case, when a can is upside down, it normally will not spray any of the desired product at all, even though the can may be full. On the other hand, when the can is upside down and the aerosol valve is actuated, propellant gas will be expelled from the can. As more and more of the product has been sprayed from a can, the closer to vertical the axis of the can must be in order to allow continued spraying of the product.

As a result of these deficiencies in the prior art spray cans, many manufacturers are returning to the production of pump sprayers by means of which the consumer may actuate a pump to pressurize the interior of the container and cause the product to be sprayed through a valve. In many cases, the valve is contained in the pumping device so that, as the consumer actuates the pump with his index finger, for example, the product is sprayed through the valve.

Some pump sprayers do not include the valve as part of the pumping device so that a pressure can be built up within the container and the spray can be released at a later time on demand. However, in most cases those sprayers are relatively bulky and require several moving parts.

All of the pump sprayers are unsatisfactory for a number of reasons, including the fact that they are rarely operable to deliver anything but compresed air when the sprayer is in the upside down or inverted position. Further, since they depend upon an external force for application, and since the amount of pressurization is rather limited, they are limited in the amount of time during which the spary can be released from the container to that time during which force can be applied. For example, in those sprayers operated by squeezing a trigger, the spray can be released only as long as it takes to fully depress the trigger. Similarly, those sprayers operated by depressing a plunger can only spray during the time required to accomplish a full depression. Further, the force of the spray varies with the speed of squeezing the trigger or depressing the plunger and this may cause an undesirable variation in velocity of the spray from one stroke to the next, as well as during a single stroke.

Even with those pump sprayers which allow a pressure to be built up prior to release of the aerosol, the time during which the spray can be released is limited by the ability of the consumer to build up pressure within the container, usually requiring a good deal of his energy and time.

Accordingly, a need has developed for an aerosol spray device which can operate free from the limitations of the pump sprayers, as well as without creating or utilizing environmentally damaging gasses. Further, it is desirable to provide such a device which is not position sensitive, i.e., which will operate in the desired manner regardless of the orientation of the container.

SUMMARY OF THE INVENTION

The present invention relates to a small, portable container of liquid, from which the liquid may be dispensed by spraying into the atmosphere or onto a surface. In the preferred embodiment of the invention, the propulsion force may be generated by a gas, preferably air, under pressure. In any event, it is preferred that the gas used be non-toxic and non-harmful to the environment. Given these limitations, any suitable gas may be used and, for the sake of this application, the term "air" shall be construed as including any such gas. Consequently, if the pressurized gas should somehow be released to the atmosphere, such as during disposal of the container, it will produce no harmful result.

The presently preferred embodiment may comprise a pair of concentric containers or cylinders, the smaller cylinder located, in telescopic fashion, within the larger container. The central cylinder may be sealed to a container end wall which may also be sealed to the outer container. The outer container may also be sealed, at the lower end thereof, either by an integral can bottom, or a bottom which is attached to the bottom end of the cylinder in any desired fashion. The inner cylinder may contain the fluid which is to be dispensed. This fluid may be sprayed through an aerosol valve which is so mounted in the container end wall as to be in fluid communication with the volume of the smaller cylinder.

The volume of the larger cylinder, containing the compressed air which is to motivate the aerosol fluid, may act against one end of a double-ended piston suitably mounted in the smaller cylinder. The volume of the larger cylinder and the end of the piston may be in communication through one or more openings in or near the end of the smaller cylinder distal from the aerosol valve. Thus, as the aerosol valve is actuated by the consumer, the pressurized gas in the larger cylinder will act against the piston to drive it toward the valve, moving the fluid to be sprayed ahead of it. In other words, as liquid is removed from the small cylinder by actuation of the aerosol valve, the active internal volume of the smaller cylinder will contract due to movement of the piston. The compressed gas will expand to take up a volume equivalent to that vacated by the fluid expelled through the aerosol valve.

Through this or equivalent structure, the liquid to be sprayed may be maintained under pressure at all times and such spraying can be accomplished by actuation of the aerosol valve, regardless of the orientation of the container. No propellent gas will be released to the atmosphere, barring damage to the container. Further, if compressed air is used for the propellant, damage to the container cannot result in the release of any environmentally harmful propellant. Depending upon the degree of compression of the propellant, the length of time during which the aerosol may be released may be varied without appreciable variation of the intensity of the spray.

Also through use of such structure as this, the product may be sprayed regardless of can orientation because the supply is always immediately adjacent to the valve.

Upon review of the following detailed description, taken together with the accompanying drawings, those skilled in the art will realize that the present invention achieves each of these desired results, while obviating all of the deficiencies of the prior art devices. Although the description and illustration relate to only the presently preferred embodiment of the invention, those skilled in the art will also become quickly aware that the present invention may be embodied in a wide variety of structures, many of which may not even resemble that depicted here.

DETAILED DESCRIPTION

Figure 1:
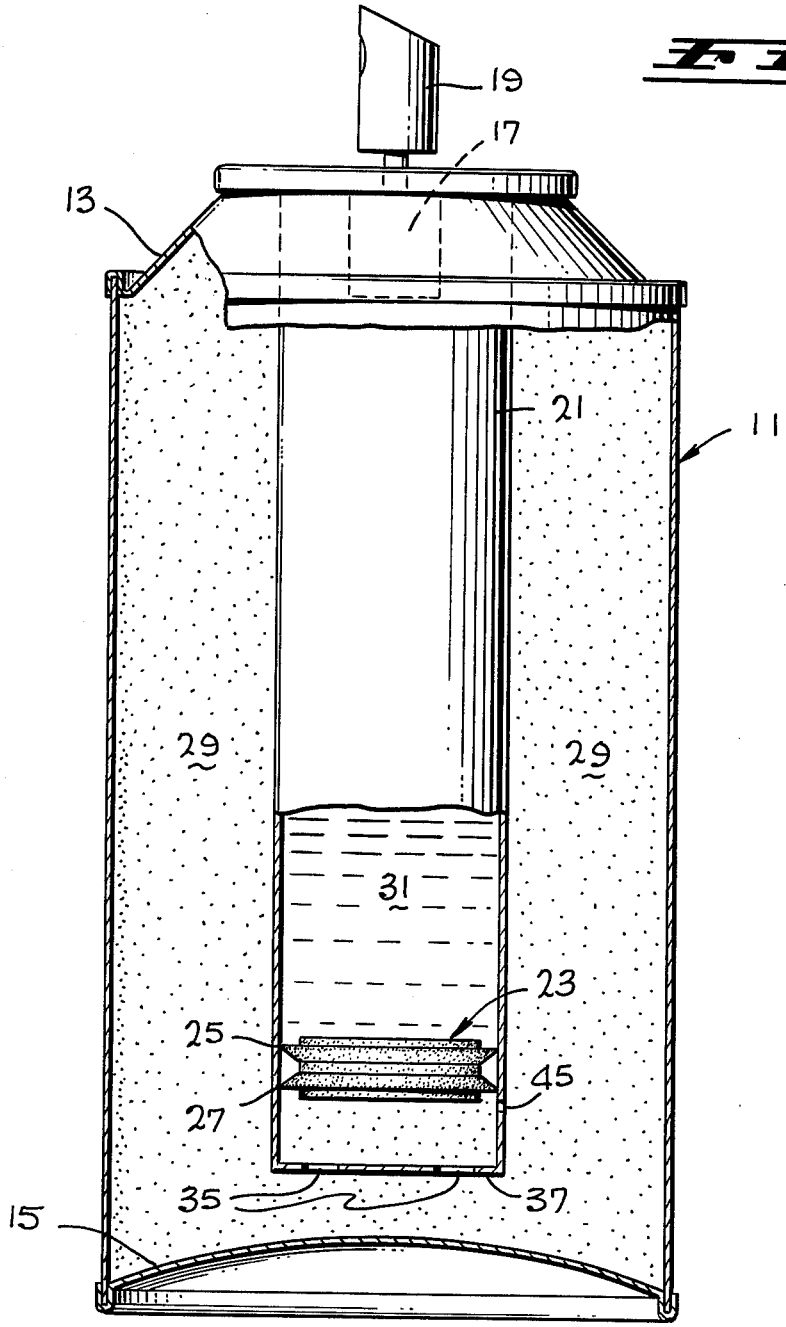
FIG. 1 comprises a longitudinal elevation, partly in section, of an aerosol spray container embodying the present invention.

As shown in FIG. 1, a preferred embodiment of the present invention may comprise an exterior, or large cylinder 11 in the nature of that presently employed for spray cans. However, it should be realized that the present invention is not limited to a circular configuration or structure but may comprise any container of any suitable configuration and construction. It will be realized, of course, that the mathematical definition of a cylinder is not limited merely to a circular peripheral configuration.

The upper end of the cylinder 11 may be closed by any suitable device, such as a container end wall 13 fastened to the cylinder 11 in any well known fashion which will prevent the release of presurized fluid within the container. The bottom of the container 11 may be closed either by an integral end wall 15, such as may be formed in a deep draw process, or by a suitably attached end wall (not shown).

The container end wall 13 may include a suitable aerosol valve 17 of any well known type in any desired position (although illustrated on the can axis). Accordingly, when the spray head 19 of the valve is depressed by the consumer, the valve will be actuated to allow fluid communication between the opposite sides of the valve. When the head 19 is released, the valve may thus be closed to prevent such fluid communication.

Although illustrated as being substantially concentric with the container 11, there may be mounted anywhere within the container a small, second container or cylinder 21 of any desired configuration. One end of the cylinder 21 may be sealed to the container end wall 13 by any suitable means which will prevent fluid communication between the inner and outer cylinders at that location. Within the cylinder 21, a double-ended piston 23 may be provided having peripheral sealing lips 25 and 27 thereon. The piston may be manufactured from any suitable material, although in this embodiment it is presently preferred to produce it from a plastic which is pliable when formed in thin sections, such as Teflon or Nylon. Consequently, the lips 25 and 27 may be formed integral with the body of the piston 23 and may be biased outwardly toward the internal wall of the cylinder 21 to form a seal against the wall at each end of the piston.

When compressed gas is located within the volume 29 of the outer cylinder 11, seal 27 will prevent it from migrating into the volume 31 within the smaller cylinder 21. Similarly, the fluid product within the volume 31 on the opposite side of piston 23 will be prevented from migrating to the volume 29 by means of the lip 25. Of course, for the sake of this discussion, volume 31 ma be considered to be the volume on one side of the piston 23 within cylinder 21 and volume 29 may be considered to include both the volume below the piston 11 in cylinder 21 and the volume within the outer cylinder 11. For this purpose, the end of cylinder 21 distal from the aerosol valve 17 may be provided with one or more apertures 35 through which the propellant gas can enter the cylinder 21 and act against the piston 23.

In the preferred embodiment of FIG. 1, the end of the cylinder 21 opposite the aerosol valve 17 may be provided with a closure member 37 in which the apertures 35 may be provided. Alternatively, of course, the apertures 35 might be provided in the side wall of the cylinder above the closure member 37. In any event, the closure member 37 may be provided to serve as a seat for the piston 23 when the latter is forced downwardly, as viewed in the drawing, for example, during filling of the container.

Figure 2:
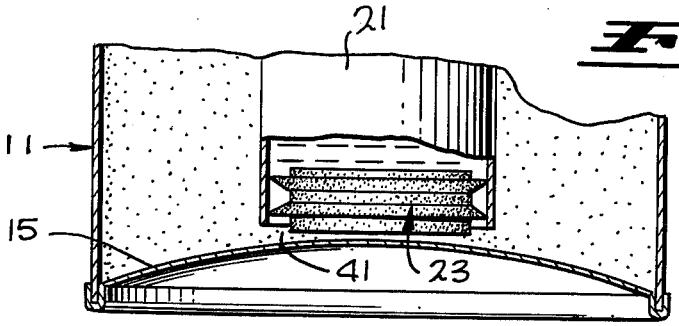
FIG. 2 comprises a partial view, similar to FIG. 1, of an alternate embodiment of the present invention.

Alternatively, as shown in FIG. 2, the end of the cylinder 21 may extend close enough to the end wall 15 of the container so that only a small opening or space 41 remains between them. Then, when the piston 23 is forced downwardly, it may be seated against the bottom of the can. In either case, the piston 23 will thus be prevented from being driven out of the cylinder 21, even to an extent which might cause the piston 23 to become slightly cocked, relative to the walls of the cylinder 21.

Although a device of this type may be filled by any suitable means, as illustrated in FIG. 1, the wall of the cylinder 21 may be provided with one or more relatively small apertures 45 through which fluid may pass when the piston 23 is low enough in the cylinder 21 that the lip 25 is below the aperture 45. In order to fill the volume 29, the aerosol valve 17 may be actuated and air injected into the cannister under pressure. The air will drive the piston 23 toward the bottom of cylinder 21, to a position in which lip 25 is below aperture 45. Thus the aperture 45 may be opened to communicate volumes 31 and 29. This will cause the volume 29 to become filled with the pressurized fluid. It is presently preferred that the fluid within the volume 29 be air since it is highly compressible without being environmentally harmful.

When a back-pressure of predetermined magnitude is sensed by the filling system, the air line (not shown) may be disconnected. Since, in this preferred embodiment, the aperture 45 is of relatively small area, whereas the total area(s) of apertures 35 is much larger, when the aerosol valve 17 is again actuated, the piston 23 will immediately travel upwardly within the cylinder 21, allowing the lip 27 to move above the bore 45, sealing the latter off from the volume 31. Continued actuation of the aerosol valve 17 will then cause the piston 23 to move up within the cylinder 21 until it contacts the valve. In this manner, the manufacturer will have completely pressurized the volume 29 and substantially evacuated and collapsed the volume 31.

The manufacturer may then connect another line to the aerosol valve 17 and, by actuating the valve again, deliver the desired product fluid, which may be a liquid, into the interior of the cylinder 21 above the piston 23. Fluid may be thus injected into the volume 31 under a pressure of predetermined maximum value which is calculated to drive the piston 23 downwardly in the cylinder 21 to a position in which the lip 25 is just above bore 45. In other words, the injection of fluid into the volume 31 may recompress the gas within volume 29. When the manufacturer again closes the aerosol valve 17, he can disconnect the filling line (not shown), and install the spary head 19. Of course, those skilled in the art will realize that any other desired structure might be employed for filling and pressurizing the container. For example, a collapsible opening might be formed in one of the container walls through which the pressurization fluid could be injected. The opening might then be sealed or crimped in any desirable manner to prevent escape of the pressurizing fluid.

In any event, those skilled in the art will now become aware that there are many other possible structural combinations which might be utilized in accordance with the principles of this teaching. Nevertheless, those embodiments, even though they may not resemble the structure described and illustrated here, will utilize the present invention which is defined by the following claims.

I claim:

1. (New) A spray container comprising
a first cylinder including
a continuous side wall
a pair of end walls sealed to said side walls and,
an aerosol valve in one of said end walls
a second cylinder within said first cylinder and sealed to said one of said end walls about said aerosol valve, piston means within said second cylinder including
means on said piston means for forming a seal about said piston means with at least a portion of the internal surface of said second cylinder wall and having
a wall having
at least one aperture in said second cylinder wall so located as to always be on a first side of said piston means regardless of the axial position of the latter within said second cylinder at least one additional aperture in said second cylinder so located as to provide fluid communication between the volume within said second cylinder on a second side of said piston and the volume within said first cylinder but outside of said second cylinder, when said piston is located at an axial position within said second cylinder at least a predetermined distance from said aerosol valve.

2. The container of claim 1 including
means for preventing said piston from leaving said second cylinder through said at least one aperture on said first side of said piston.

3. In a spray can of claim 1,
the method of filling said spray can comprising the steps of
pressurizing the interior of said can by injecting a fluid under pressure thereinto, thereby
forcing said piston within said spray can to a position relatively remote from said aerosol valve and
delivering the pressurized fluid to a volume normally sealed off by said piston from the volume adjacent said aerosol valve
releasing any pressure in that volume of said spray can between said piston and said aerosol valve, and
injecting a fluid to be sprayed from said can into the volume above said piston.

4. The method of claim 3 wherein
said step of injecting is accomplished until a predetermined maximum pressure of the fluid to be sprayed is achieved.

* * * * *